US011410594B1

(12) United States Patent
Chen et al.

(10) Patent No.: US 11,410,594 B1
(45) Date of Patent: Aug. 9, 2022

(54) DYNAMIC BIAS CONTROL OF SOURCE DRIVER BASED ON DATA SWING LEVEL FOR POWER SAVING

(71) Applicant: NOVATEK MICROELECTRONICS CORP., Hsinchu (TW)

(72) Inventors: Chun-Hung Chen, Yunlin County (TW); Chia-Hsin Tung, Hsinchu (TW); Hsin-Hung Ou, Kaohsiung (TW); Hung-Yi Lin, Hsinchu (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 0 days.

(21) Appl. No.: 17/325,215

(22) Filed: May 20, 2021

(51) Int. Cl.
*G09G 3/20* (2006.01)

(52) U.S. Cl.
CPC ..... *G09G 3/2007* (2013.01); *G09G 2310/027* (2013.01); *G09G 2310/0286* (2013.01); *G09G 2310/0291* (2013.01); *G09G 2310/0297* (2013.01); *G09G 2330/021* (2013.01)

(58) Field of Classification Search
CPC ..... G09G 3/2007
USPC ..... 345/690
See application file for complete search history.

(56) References Cited

U.S. PATENT DOCUMENTS

2016/0049133 A1* 2/2016 Park ..... G09G 3/3688 345/212
2016/0093270 A1* 3/2016 Lee ..... G09G 3/3688 345/690
2020/0226982 A1* 7/2020 Tung ..... G09G 3/3275

* cited by examiner

*Primary Examiner* — Long D Pham

(57) ABSTRACT

A method of dynamic bias control of a source driver bases on data wing level for power-saving. In order to cover the operating conditions of various loads under normal operations, the output buffer circuit operation is biased. The method utilizes the display gray scale difference between a previous data line and an immediately subsequent data line to determine the bias current to be used for the output buffer. When the difference between the current data line display gray scale and the previous data line display gray scale is not large, the bias current of the output buffer can be reduced. When the difference between the current data line display gray scale and the previous data line display gray scale is large, the bias current of the output buffer is increased and the current of the output buffer is adjusted according to different load conditions to save power.

4 Claims, 5 Drawing Sheets

DYNAMIC BIAS CONTROL OF SOURCE DRIVER BASED ON DATA SWING LEVEL FOR POWER SAVING

BACKGROUND OF THE INVENTION

1. Field of the Invention

The present disclosure relates to dynamic bias control of a source driver, and in particular to dynamic bias control of a source driver that is based on the data swing level thereby saving power.

2. Description of the Related Art

In order to respond to the load conditions of various panels and maintain the operating bandwidth of the output buffer in the source driver circuit, the operating bias current of the traditional source driver must be large enough to meet the rise time of the panel under light and heavy load operation.

However, in this way, the bias current of the output buffer is usually designed at a relatively large and fixed current value to cover the application conditions of light and heavy loads on the panel.

As a result, the bias current cannot be adjusted according to the load conditions. Therefore, dynamic adjustment in the conventional device is not achievable, so the prior art produces greater power consumption.

Refer to FIG. 1, which is a drawing illustrating a circuit structure of a conventional source driver of the prior art.

The conventional source driver circuit 100 comprises a data process unit 110, shift registers 120A-120D, data latches 130A-130D, level shifters 140A-140D, a gamma circuit 160, digital to analog converters (DAC) 150A-150D, source driver operational amplifiers (SOP) 180A-180D, and a bias current generation circuit 170.

In operation, initially the data processing unit 110 captures the displayed input data via the DIO and CLK until the corresponding complete line of data is shifted into the shift register. Then, the line of data that is stored in the shift registers 120A-1220D is loaded into the data latches 130A-130D using the load signal. Then, the line of data is sent to the level shifters 140A-140D to convert the low-voltage control signal into a medium-voltage control signal. The digital to analog converters 150A-150D select the corresponding Gamma gray scale based on the level converted input data. The step voltage is sent to the input terminal of the source driver operational amplifiers (SOP) 180A-180D and the SOP is used as a buffer to increase the source output driving.

However, in the conventional circuit, in the normal mode of operation, in order to reduce the power consumption of the source driver the bias current of the SOP is usually reduced as much as possible under the driving force of the SOP. Alternatively, the SOP is turned on in the display area and the SOP is turned off in the non-display area in order to save the power consumption of the source driver.

However, with the demand for increased mobile phone standby time, the conventional power saving method of the source driver is unable to meet the requirements of consumers. In order to meet new power consumption specifications and requirements, a new power saving control method for a source driver is needed.

Thus, it is desirable to have improvements in the conventional method and display panels in order to decrease power consumption.

BRIEF SUMMARY OF THE INVENTION

An objective of the present disclosure is to provide a method for dynamic bias control of a source driver that is based on the data swing level thereby saving power.

To achieve at least the above objective, the present disclosure provides a power-saving control method wherein in order to cover the operating conditions of various loads under normal operations, the output buffer circuit operation is biased.

Therefore, the entire power consumption conditions can be optimized. The method of the present invention utilizes the display gray scale difference between a previous data line and an immediately subsequent data line to determine the bias current of the output buffer. When the difference between the current data line display gray scale and the previous data line display gray scale is not large, the bias current of the output buffer can be reduced. When the difference between the current data line display gray scale and the previous data line display gray scale is large, the bias current of the output buffer is increased and the current of the output buffer is adjusted according to different load conditions to save power.

According to the analysis of normal color images, most graphics usually have similar colors near adjacent pixels. Compare the display grayscale data code of the previous data line and the immediately subsequent data line to make statistics of the entire image, and it can be found that most of the general color images that are displayed have a difference in grayscale data code that falls between level 0 and level 1 (LV0~LV1), and usually only a few percent of the displayed grayscale data code difference falls between level 2 and level 3 (LV2~LV3).

For example, comparing the display grayscale level data difference of the data line before and after an example image, statistics regarding the whole image can be made. In an example, it was found that at least 96% of the display grayscale level data difference will fall into the LV0 interval, and about 3.6% of the displayed grayscale level data difference will fall into the LV1 range. The remaining 0.4% of the display grayscale level data difference will fall into the LV2 and LV3 interval.

The display grayscale data code difference between the previous data line and the following data line is used to determine the bias current of the output buffer. For example, the bias current of the output buffer is divided into 4 levels. When the display grayscale data code difference between the previous data line and the following data line is small or constant, the bias current of the output buffer is selected to be the smallest level. Because the display grayscale data code difference is very small, a smaller bias current can be used to charge the load. Similarly, when the display grayscale data code difference between the previous data line and the immediately following data line is moderate, the bias current of the output buffer can be adjusted to a moderate level, and the load can be charged with a moderate bias current. When the display grayscale data code difference between a previous data line and an immediately subsequent data line is large, the bias current of the output buffer is adjusted to be increased, and the charging and discharging time of the panel can be maintained. When the display grayscale data code difference between a previous data line and an immediately subsequent data line is very large, the bias current of the output buffer can be adjusted to the maximum, because the charging time and the bias current is inversely proportional, so increasing the current can maintain the charging and discharging time.

DETAILED DESCRIPTION OF THE INVENTION

To facilitate understanding of the object, characteristics and effects of this present disclosure, embodiments together with the attached drawings for the detailed description of the present disclosure are provided.

The present disclosure provides a power-saving control method wherein in order to cover the operating conditions of various loads under normal operations, the output buffer circuit operation is biased. Therefore, the entire power consumption conditions can be optimized. The method of the present invention utilizes the display gray scale difference between a previous data line and an immediately subsequent data line to determine the bias current of the output buffer. When the difference between the current data line display gray scale and the previous data line display gray scale is not large, the bias current of the output buffer can be reduced. When the difference between the current data line display gray scale and the previous data line display gray scale is large, the bias current of the output buffer is increased and the current of the output buffer is adjusted according to different load conditions to save power.

Figure 5B:
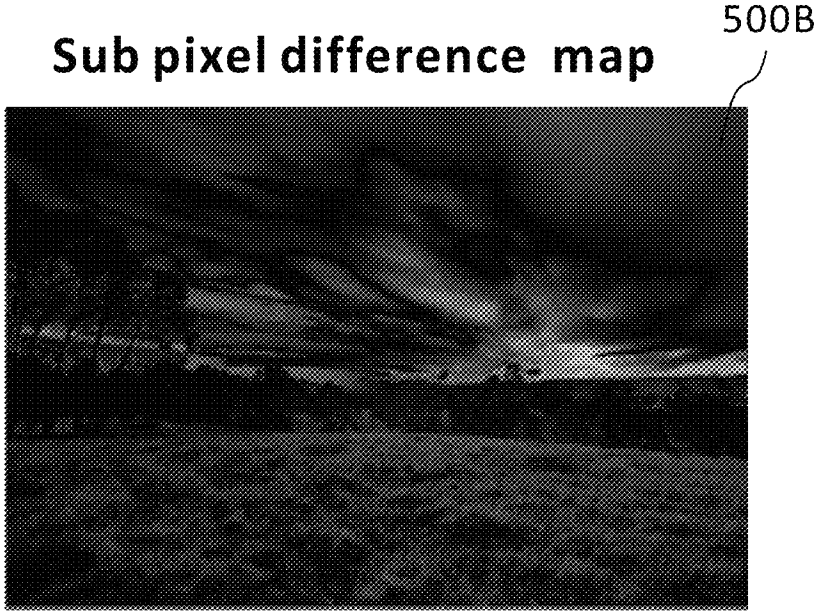
FIG. 5B is a sub pixel difference map of the image of FIG. 5A.
Figure 5A:
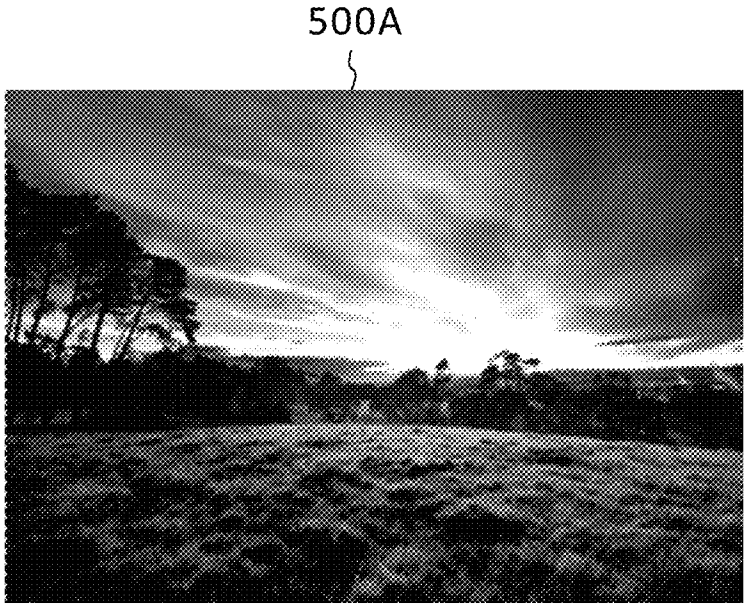
FIG. 5A is a photographic image.

Refer to FIG. 5A, which is a photographic image and to FIG. 5B, which is a sub pixel difference map of the image of FIG. 5A.

According to the analysis of normal color images, most graphics usually have similar colors near adjacent pixels. By comparing the display grayscale data code of the previous data line and the immediately subsequent data line to make statistics of the entire image, and it can be found that most of the general color images that are displayed have a difference in grayscale data code that falls between level 0 to level 1 (LV0~LV1), and usually only a few percent of the displayed grayscale data code difference fall between level 2 to level 3 (LV2~LV3).

For example, comparing the display grayscale level data difference of the data line before the current data line and the current data line of an example image, statistics regarding the whole image can be made. In an example, it was found that at least 96.0% of the display grayscale level data difference will fall into the LV0 interval, and about 3.6% of the displayed grayscale level data difference will fall into the LV1 range. The remaining 0.4% of the display grayscale level data difference will fall into the LV2 and LV3 interval.

The display grayscale data code difference between the immediately preceding data line and the current data line is used to determine the bias current of the output buffer. For example, the bias current of the output buffer is divided into 4 levels. When the display grayscale data code difference between the previous data line and the current data line is small or constant, the bias current of the output buffer is selected to be the smallest level. Because the display grayscale data code difference is very small, a smaller bias current can be used to charge the load. Similarly, when the display grayscale data code difference between the previous data line and the current data line (immediately following data line) is moderate, the bias current of the output buffer can be adjusted to a moderate level, and the load can be charged with a moderate bias current. When the display grayscale data code difference between a previous data line and the current data line (immediately subsequent data line) is large, the bias current of the output buffer is adjusted to be increased, and the charging and discharging time of the panel can be maintained. When the display grayscale data code difference between a previous data line and the current data line is very large, the bias current of the output buffer can be adjusted to the maximum, because the charging time and the bias current is inversely proportional, so increasing the current can maintain the charging and discharging time.

FIG. 5A and FIG. 5B shows the classification of the difference in grayscale data code displayed by the previous H line and the current H line (H line immediately following the previous H line). Also, refer to Table 1 shown below.

Compare the sub-pixels of the general color picture and the difference between the grayscale data code displayed on the preceding H line and the following H line. After processing the data of the complete frame, we can get sub-pixel data of the whole picture and show the sub-pixel difference map of the data, and then according to the display gray level data difference of each sub-pixel, it is classified into 4 intervals: LV0: data difference level <63 code; LV1: 64 code <data difference level <127 code; LV2: 128 code <data difference level <191 code; LV3: 192 code <data difference level <255 code, where LV0 represents the minimum condition for displaying gray scale data difference, and LV4 represents the condition for the maximum display gray scale data difference. Generally, most of the display gray scale data difference of color images falls between LV0~LV1, and usually only a few percentages of the displayed gray scale data difference fall between LV2~LV3.

For example, by comparing the display gray scale data difference of the preceding H line and the following H line and making statistics of the whole picture, it can be found that at least 96.0% of the display gray scale data difference will fall in the LV0 interval, and about 3.6% of the display gray scale data difference will fall in the LV1 interval, the remaining 0.4% of the display gray scale data difference will fall in the LV2 and LV3 interval. Therefore, this feature can be used to control and classify the bias current of source operational amplifier (SOP) by using BIASOP0~BIASOP3.

When the sub-pixel display grayscale data code difference value is in LV0, the SOP current can be selected to a minimum current level; BIASOP0, and when the sub-pixel display gray scale data difference is in the range of LV4, the current of the SOP can be selected to a maximum current level; BIASOP3. Compared with the traditional method, the present invention can effectively reduce the bias current of the SOP, so power consumption can be effectively reduced.

TABLE 1

| | The difference in grayscale data code between a preceding H line and a current H line | Percent (%) |
|---|---|---|
| LV0 | data difference level < 63 code | 96.00182051 |
| LV1 | 64 code < data difference level < 127 code | 3.655924479 |
| LV2 | 128 code < data difference level < 191 code | 0.339035976 |
| LV3 | 192 code < data difference level < 255 code | 0.003219039 |

Figure 1:
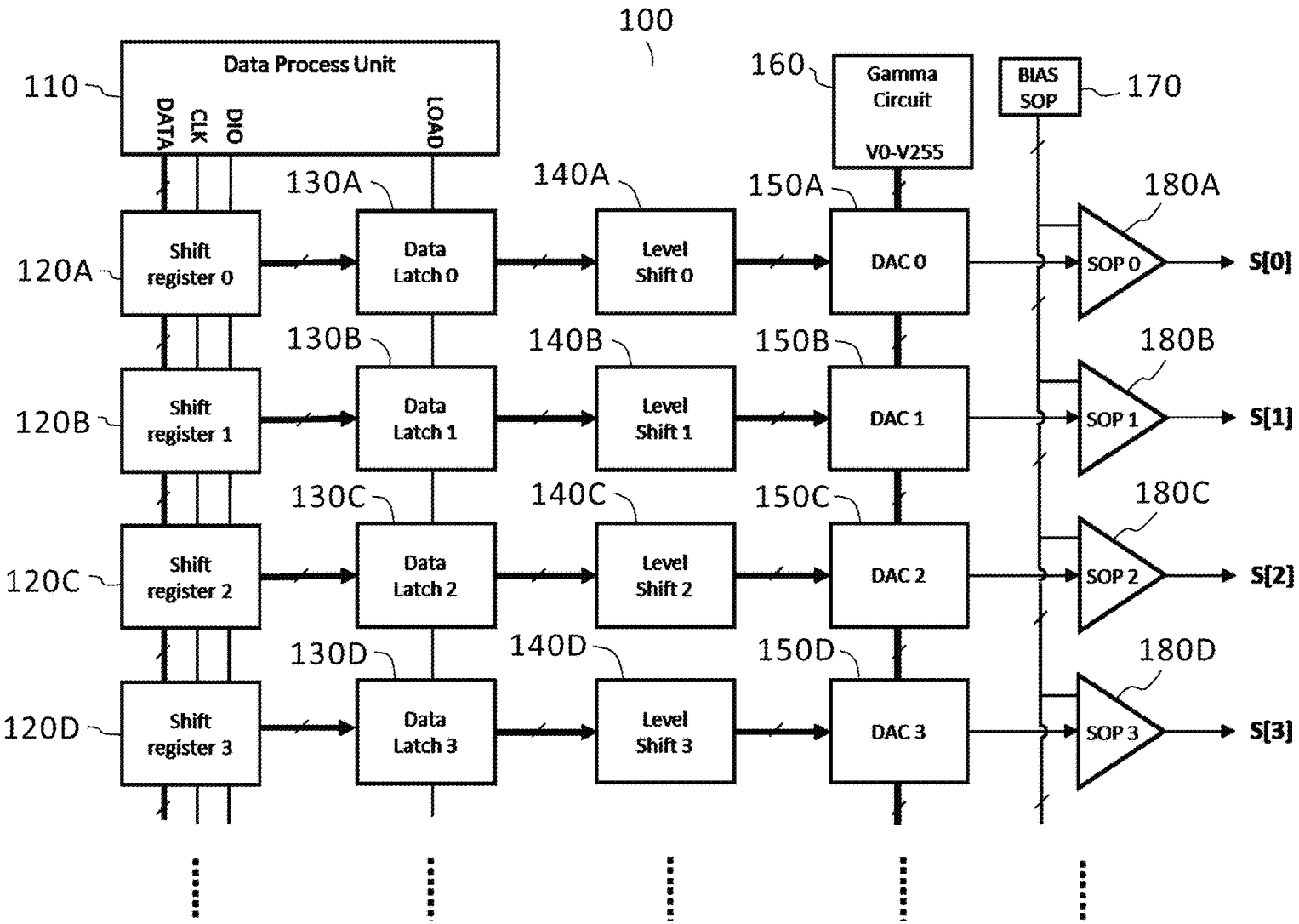
Figure 1 PRIOR ART
FIG. 1 is a drawing illustrating a source driver circuit of the prior art.
Figure 2:
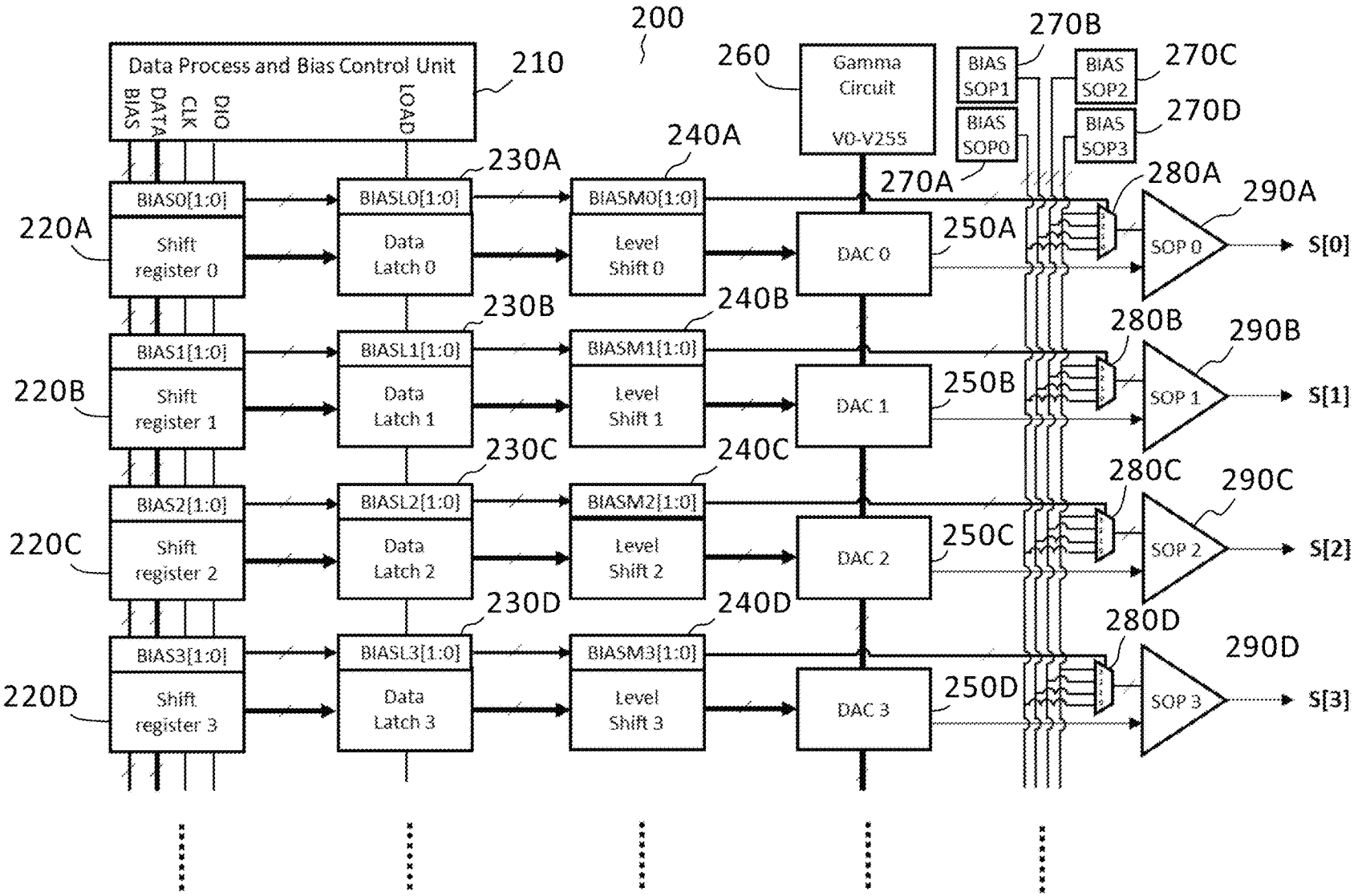
FIG. 2 is a drawing illustrating a source driver circuit with dynamic bias control based on data difference according to an embodiment of the present invention.

Refer to FIG. 2, which is a drawing illustrating a source driver circuit with dynamic bias control based on data difference according to an embodiment of the present invention.

The source driver circuit 200 with dynamic bias control based on data difference comprises a data processing and bias control unit 210, a plurality of shift registers 220A, 220B, 220C, 220D, a plurality of data latches 230A, 230B, 230C, 230D, a plurality of level shifters 240A, 240B, 240C, 240D, a plurality of digital to analog converters 250A, 250B, 250C, 250D, a plurality of multiplexers 280A, 280B, 280C, 280D, a plurality of source driver operational amplifiers (SOP) 290A, 290B, 290C, 290D, a Gamma circuit 260, and a plurality of bias generators 270A, 270B, 270C, 270D.

The data processing and bias control unit 210 comprises a bias control (BIAS), a data output (DATA), a clock output (CLK), and a data input output (DIO). The bias control is connected to each of the plurality of shift registers 220A, 220B, 220C, 220D. The bias control provides a bias control signal to each of the plurality of shift registers 220A, 220B, 220C, 220D.

The data output is connected to each of the plurality of shift registers 220A, 220B, 220C, 220D. The data output provides H line data to each of the shift registers 220A, 220B, 220C, 220D.

The clock output is connected to each of the plurality of shift registers 220A, 220B, 220C, 220D.

The data input output is connected to each of the plurality of shift registers 220A, 220B, 220C, 220D.

The plurality of shift registers 220A, 220B, 220C, 220D is electrically connected to the plurality of data latches 230A, 230B, 230C, 230D. For example, the output of shift register 220A is connected to the input of data latch 230A, the output of shift register 220B is connected to the input of data latch 230B, the output of shift register 220C is connected to the input of data latch 230C, the output of shift register 220D is connected to the input of data latch 230D, etc.

The data processing and bias control unit 210 further comprises a load output (LOAD). The load output is connected to each of the plurality of data latches 230A, 230B, 230C, 230D. The load output provides a load control signal to each of the plurality of data latches 230A, 230B, 230C, 230D.

The plurality of data latches 230A, 230B, 230C, 230D is electrically connected to the plurality of level shifters 240A, 240B, 240C, 240D. For example, the output of data latch 230A is connected to the input of level shifter 240A, the output of data latches 230B is connected to the input of level shifter 240B, the output of data latches 230C is connected to the input of level shifter 240C, the output of data latch 230D is connected to the input of level shifter 240D, etc.

The plurality of level shifters 240A, 240B, 240C, 240D are electrically connected to the plurality of digital to analog converters (DAC) 250A, 250B, 250C, 250D. For example, the output of level shifter 240A is connected to the input of DAC 0 250A, the output of level shifter 240B is connected to the input of DAC 1 250B, the output of level shifter 240C is connected to the input of DAC 2 250C, the output of level shifter 240D is connected to the input of DAC 3 240D, etc.

The Gamma circuit 260 comprises a voltage level output (V0-V255). The voltage level output is connected to each of the plurality of digital to analog converters (DAC) 250A, 250B, 250C, 250D. The voltage level output provides a voltage level signal to each of the plurality of digital to analog converters (DAC 0, DAC 1, DAC 2, DAC 3) 250A, 250B, 250C, 250D.

The plurality of digital to analog converters 250A, 250B, 250C, 250D is electrically connected to the plurality of source driver operational amplifiers (SOP) 290A, 290B, 290C, 290D. For example, the output of DAC 0 250A is connected to the input of SOP 0 290A, the output of DAC 1 250B is connected to the input of SOP 1 290B, the output of DAC 2 250C is connected to the input of SOP 2 290C, the output of DAC 3 250D is connected to the input of SOP 3 290D, etc.

The bias control (BIAS) of the data processing and bias control unit 210 is connected to each of the plurality of shift registers 220A, 220B, 220C, 220D. The bias control provides a bias control signal to each of the plurality of shift registers 220A, 220B, 220C, 220D.

For example, the bias control (BIAS) provides a BIAS0 [1:0] signal to shift register 0 220A, the bias control (BIAS) provides a BIAS1[1:0] signal to shift register 1 220B, the bias control (BIAS) provides a BIAS2[1:0] signal to shift register 2 220C, the bias control (BIAS) provides a BIAS3 [1:0] signal to shift register 3 220D.

The BIAS0[1:0] signal of shift register 0 220A provides a bias signal BIASL0[1:0] signal to data latch 0 230A, the BIAS1[1:0] signal of shift register 1 220B provides a bias signal BIASL1[1:0] signal to data latch 1 230B, the BIAS2 [1:0] signal of shift register 2 220C provides a bias signal BIASL2[1:0] signal to data latch 2 230C, and the BIAS3 [1:0] signal of shift register 3 220D provides a bias signal BIASL3[1:0] signal to data latch 3 230D.

The BIASL0[1:0] signal of data latch 0 230A provides a bias signal BIASM0[1:0] signal to level shifter 0 240A, the BIASL1[1:0] signal of data latch 1 230B provides a bias signal BIASM1[1:0] signal to level shifter 1 240B, the BIASL2[1:0] signal of data latch 2 230C provides a bias signal BIASM2[1:0] signal to level shifter 2 240C, the BIASL3[1:0] signal of data latch 3 230D provides a bias signal BIASM3[1:0] signal to level shifter 3 240D.

The plurality of level shifters 240A, 240B, 240C, 240D provides bias control signals to the plurality of multiplexers 280A, 280B, 280C, 280D. For example, the BIASM0[1:0] signal of level shifter 0 240A provides a bias signal to multiplexer 280A, the BIASM1[1:0] signal of level shifter 1 240B provides a bias signal to multiplexer 280B, the BIASM2[1:0] signal of level shifter 2 240C provides a bias signal to multiplexer 280C, and the BIASM3[1:0] signal of level shifter 3 240D provides a bias signal to multiplexer 280D.

Each of the plurality of bias generator 270A, 270B, 270C, 270D provides bias select signals to the plurality of multiplexers 280A, 280B, 280C, 280D. For example, bias generator BIAS SOP0 270A is electrically connected to each of the plurality of multiplexers 280A, 280B, 280C, 280D, bias generator BIAS SOP1 270B is electrically connected to each of the plurality of multiplexers 280A, 280B, 280C, 280D, bias generator BIAS SOP2 270C is electrically connected to each of the plurality of multiplexers 280A, 280B, 280C, 280D, and bias generator BIAS SOP3 270D is electrically connected to each of the plurality of multiplexers 280A, 280B, 280C, 280D.

The output control signal of BIASM0[1:0] of level shifter 0 240A is electrically connected to multiplexer 280A. The output of multiplexer 280A is electrically connected to the input of SOP0 290A. Also, the output of DAC 0 250A is electrically connected to an input of SOP 0 290A. The output of SOP 0 290A provides the output signal S[0] of the source driver 200.

The output control signal of BIASM1[1:0] of level shifter 1 240B is electrically connected to multiplexer 280B. The output of multiplexer 280B is electrically connected to the input of SOP1 290B. Also, the output of DAC 1 250B is electrically connected to an input of SOP 1 290B. The output of SOP 1 290B provides the output signal S[1] of the source driver 200.

The output control signal of BIASM2[1:0] of level shifter 2 240C is electrically connected to multiplexer 280C. The output of multiplexer 280C is electrically connected to the input of SOP2 290C. Also, the output of DAC 2 250C is electrically connected to an input of SOP 2 290C. The output of SOP 2 290C provides the output signal S[2] of the source driver 200.

The output control signal of BIASM3[1:01] of level shifter 3 240D is electrically connected to multiplexer 280D. The output of multiplexer 280D is electrically connected to the input of SOP3 290D. Also, the output of DAC 3 250D is electrically connected to an input of SOP 3 290D. The output of SOP 3 290D provides the output signal S[3] of the source driver 200.

It should be noted that in embodiments of the present invention, the number of shift registers, data latches, level shifters, DACs, multiplexers, BIASSOPs, and source operational amplifiers is expandable to meet requirements.

In the embodiment illustrated in FIG. 2, the source driver circuit 200 mainly comprises: a data processing and bias control circuit 210, a plurality of shift registers 220A-220D, a plurality of data latches 230A-230D, a plurality of level converters or level shifters 240A-240D, a gray-scale voltage generator or Gamma circuit 260, a plurality of digital-to-analog converters (DAC) 250A-250D, and a plurality of source driver operational amplifiers (SOP) 290A-290D.

The bias current generation portion of the circuit works as follows: the data processing and bias control circuit compares each preceding sub-pixel and the current sub-pixel in the display data of the H line to determine the degree of difference in the display data of each sub-pixel in the next line, and then determines the corresponding bias current level according to the degree of difference in the display data of each sub-pixel. The SOP bias current is mainly divided into 4 bias current levels. According to the previous pixel and the current pixel in the H line display data, the grayscale data code change amount is obtained, and the SOP bias current is adjusted in time.

Figure 3:
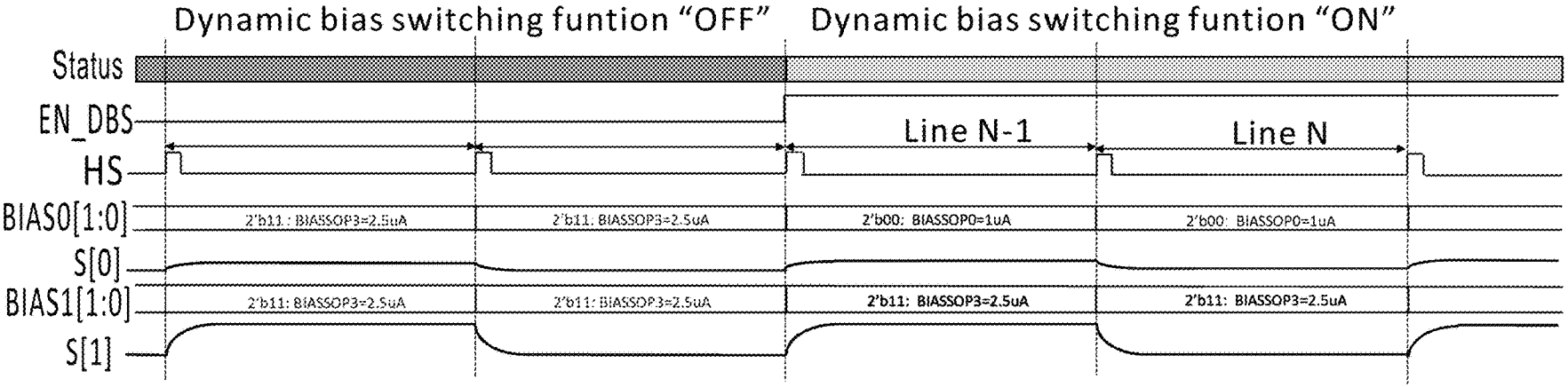
FIG. 3 is a diagram illustrating timing of data management according to an embodiment of the present invention.

Refer to FIG. 3, which is a diagram illustrating timing of data management according to an embodiment of the present invention while continuing to refer to FIG. 2.

The control method is shown in FIG. 3 according to the preceding line and the current line as well as the timing of the dynamic bias current switching of the display grayscale data code. When EN_DBS=0, the dynamic bias current function is turned off, and the data processing and bias control unit will force BIAS0[1:0], BIAS1[1:0] to be set to 2'b11, without judging the difference of the displayed grayscale data code of the previous H line and the current H line, regardless of the difference in the display data of the H line before and after the SOP, BIASSOP will always use the maximum bias current to drive the SOP, so it cannot achieve power saving processing. However, when EN_DBS=1, the function representing the dynamic bias current is activated. The data processing and bias control unit 210 will dynamically adjust the BIASSOP level of the bias current according to the difference in the grayscale data code displayed on the preceding and current H line data. For example, when the data difference of S[0] in Line N−1 and N is small, the output swing of S[0] is expected to be small, so the data processing and bias control unit 210 will use a smaller bias current to drive the SOP to save power. While the data difference of S[1] in Line N−1 and N is large, the output swing of S[1] is expected to be large, so the data processing and bias control unit 210 will use a larger bias current to drive the SOP to achieve the demand for settling time.

After the data processing and bias control unit 210 determines that the sub-pixel displays the information from DATA and the bias control BIAS, then the level settings corresponding to the sub-pixel input data and bias control are sent to the shift register 220A-220D. Through DIO and CLK, the displayed data and the bias current scale are captured one by one and the complete line of data is captured into the shift register 220A-220D. Then use the LOAD signal for the data latch 230A-230D to store a complete H line input data in the shift register 220A-220D and select the bias current for each channel SOP BIASL0[1:0], BIASL1[1:0], BIASL2[1:0], BIASL3[1:0] . . . , load the data latch 230A-230D and send it to the level shifter 240A-240D and change the low-voltage control signal to the medium-voltage control. The signal allows the DAC 250A-250D to select the corresponding Gamma gray-scale voltage and send it to the input terminal of the SOP 290A-290D according to the input data. The levels of the SOP bias current of each sub-pixel are based on the SOP output expected data determined by the amount of difference in grayscale data code. When the expected grayscale data code difference of the SOP output is larger, the corresponding bias current is larger, which means that the current grayscale data code to be displayed in the channel has a large difference from the output of the previous H line so the SOP 290A-290D must use a larger bias current so that the source output of the channel can meet the settling time requirements. When the expected grayscale data code difference of the SOP output is smaller, the corresponding bias current setting is smaller, which means that the current grayscale data code to be displayed in the channel and the output difference of the previous H line are very small, and only a small bias current is needed. That is, the source of the channel can meet the settling time requirements. Through this power-saving approach, an appropriate current level can be selected for bias current for the SOP to solve the problem of insufficient thrust when the source output requires a large thrust. At the same time, when the source output does not require a large thrust, select the setting of low bias current, to achieve the purpose of power saving.

Sometimes in order to reduce the source fan-out of the panel and reduce the area of the DrIC chip, a time-sharing technique can be used to allow 1 set of source channels to sequentially push 2 or more sub-pixels on the panel. The method is usually called 2SSD; if it is a group of sources, it usually pushes 3 sub-pixels, and it is usually called 3SSD, and so on.

Figure 4:
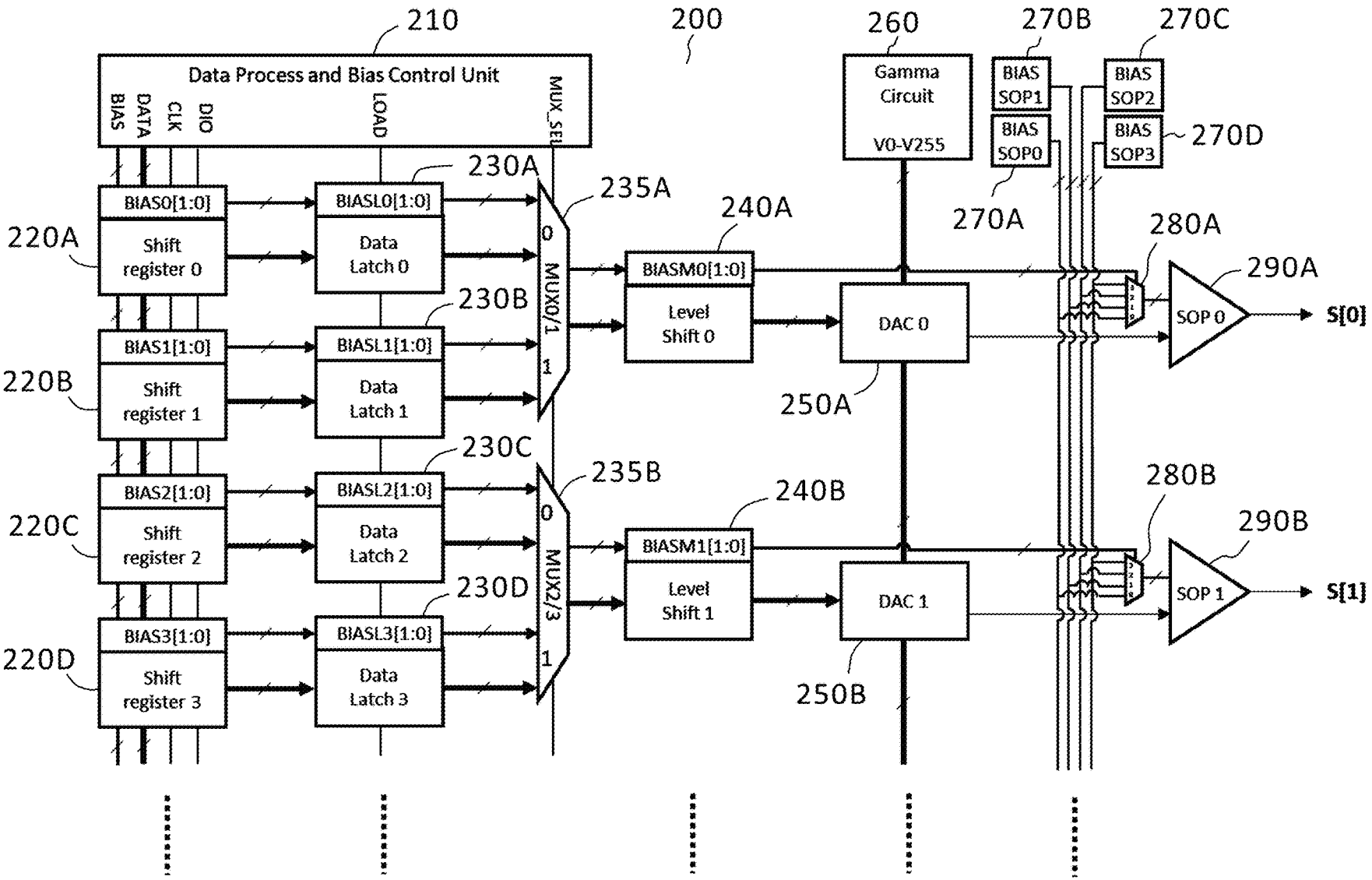
FIG. 4 is a drawing illustrating a source driver circuit with dynamic bias control based on data difference according to an embodiment of the present invention.

Refer to FIG. 4 is another embodiment of the present invention. This embodiment utilizes a 2SSD architecture with 1 channel pushing 2 sub-pixels. Compared with the first embodiment of FIG. 2, the embodiment of FIG. 3 comprises the addition of MUX0/1 235A and MUX2/3 235B and the number of original circuit groups of level shifters, DACs and SOPs can be halved, effectively reducing the chip area.

The power-saving approach can also be applied, and its operating principle is as follows: the circuit 200 mainly comprises: a data process and bias control unit 210, a plurality of shift registers 220A-220D, a plurality of data latches 230A-230D, a plurality of level shifters 240A-240B, a Gray-scale voltage generator or Gamma circuit 260, multiplexers (MUX) 280A-280B, a plurality of digital-to-analog converters (DAC) 250A-250B, and a plurality of source driver operational amplifiers (SOP) 290A-290B.

The bias current generation circuit operates as follows: the data process and bias control unit 210 compares the data displayed before and after each sub-pixel and is used to determine the degree of difference in the display data of each sub-pixel in the next line, and then the corresponding bias current level is determined according to the degree of difference in the display data of each sub-pixel. The SOP bias current is mainly divided into 4 bias current levels. According to the H line before and after the display graphic, the grayscale data code change amount is obtained, and the SOP bias current is adjusted in real-time, and then corresponds to the sub-pixel input data and bias voltage respectively. The current level setting is sent to the shift register, and the displayed data and the bias current level are captured one by one into the shift registers through DIO and CLK.

Then use the LOAD signal of the data latch to store a complete line of input data in the shift register and select the bias current BIAS[1:0] for each channel SOP, and load the data latch and select MUX0/1 and MUX2/3 to output from the 0 path or the 1 path through the control signal of MUX_SEL. When MUX_SEL is LOW, the input data of even numbers (0, 2 . . . ) and the related control levels of BIASL0[1:0], BIASL2[1:0] . . . will be selected and sent to the level shift converter or level shifter. Change the low-voltage control signal to the medium-voltage control signal, so that the DAC can select the corresponding Gamma gray-scale voltage according to the input data and send it to the input terminal of the SOP. When MUX_SEL is HIGH, the input data of odd numbers (1, 3 . . . ) and the related control levels of BIASL1[1:0], BIASL3[1:0] . . . will be selected and sent to the input terminal of the level shifter. Then the level converter will also change the time-sharing input data and control signal from the original low-voltage control signal to the medium-voltage control signal, so that the DAC can select the corresponding Gamma gray-scale voltage according to the input data and send it to the input terminal of SOP.

Since the BIAS scale of each sub-pixel's bias current is determined based on the expected data difference of the SOP output, when the expected data difference of the SOP output is larger, the corresponding bias current is larger, which means that the current data to be displayed in the channel has a large difference from the output of the previous H line and the SOP must use a larger bias current, so that the source output of the channel can meet the settling time requirements.

When the expected data difference of the SOP output is smaller, the corresponding bias current setting is smaller, which means that the current data to be displayed in the channel and the output difference of the previous H line are very small, and only a small bias current is needed. That is, the source of the channel can meet the settling time requirements. Through this power-saving approach, we can select a high bias current for the SOP to solve the problem of insufficient thrust when the source output requires a large thrust. At the same time, when the source output does not require a large thrust, let the SOP select the setting of low bias current in order to save power. With the time-sharing driving of MUX_SEL, the power saving method of the present invention can be used in a 2SSD architecture, and at the same time, if the charging time of the panel allows, it is also applicable to a one-to-many architecture.

While the present disclosure has been described by means of specific embodiments, numerous modifications and variations could be made thereto by those skilled in the art without departing from the scope and spirit of the present disclosure set forth in the claims.

What is claimed is:

1. A method for dynamic bias control of a source driver circuit comprising:

determining a difference in grayscale data code between a preceding data line and a current data line;

determining a bias current for an output of the source driver circuit based on the difference in grayscale data code; and setting the bias current for the output of the source driver circuit;

wherein, when the difference in grayscale data code is smaller, the bias current is reduced;

wherein, when the difference in grayscale data code is larger, the bias current is increase; and wherein there are four levels of bias current and when the difference in grayscale data code is less 63 the bias current is set to a first level, when the difference in grayscale data code is between 64 and 127 the bias current is set to a second level larger than the first level, when the difference in grayscale data code is between 128 and 191 the bias current is set to a third level larger than the second level, and when the difference in grayscale data code is between 192 and 255 the bias current is set to a fourth level larger than the third level.

2. A source driver circuit with dynamic bias control comprising:

a plurality of source operational amplifiers for providing outputs of the source driver circuit; and a data processing and bias control unit for determining a difference in grayscale data code between a preceding data line and a current data line, determining an appropriate bias current for the plurality of source operational amplifiers of the source driver circuit based on the difference in grayscale data code, and sending a selecting signal for the appropriate bias current for the source operational amplifiers;

wherein there are four levels of bias current and when the difference in grayscale data code is less than 63 the bias current is set to a first level, when the difference in grayscale data code is between 64 and 127 the bias current is set to a second level larger than the first level, when the difference in grayscale data code is between 128 and 191 the bias current is set to a third level larger than the second level, and when the difference in grayscale data code is between 192 and 255 the bias current is set to a fourth level larger than the third level.

3. The source driver circuit with dynamic bias control according to claim 2, further comprising:

a plurality of bias generators electrically connected to the plurality of source operational amplifiers via a plurality of multiplexers.

4. A source driver circuit with dynamic bias control comprising:

a data processing and bias control unit;

a plurality of shift registers electrically connected to the data processing and bias control unit;

a plurality of data latches electrically connected to outputs of the plurality of shift registers;

a plurality of level shifters electrically connected to output of the plurality of data latches;

a plurality of digital-to-analog converters electrically connected to outputs of the plurality of level shifters;

a plurality of source operational amplifiers connected to outputs of the plurality of digital-to-analog converters;

a gamma circuit electrically connected to the plurality of digital-to-analog converters; and a plurality of bias generators electrically connected to the plurality of source operational amplifiers via a plurality of multiplexers;

wherein the data processing and bias control unit determines a difference in grayscale data code between a preceding data line and a current data line, determines an appropriate bias current for the source operational amplifiers based on the difference in grayscale data code, and sends a selecting signal for the appropriate bias current for the source operational amplifiers; and wherein there are four levels of bias current and when the difference in grayscale data code is less 63 the bias current is set to a first level, when the difference in grayscale data code is between 64 and 127 the bias current is set to a second level larger than the first level, when the difference in grayscale data code is between 128 and 191 the bias current is set to a third level larger than the second level, and when the difference in grayscale data code is between 192 and 255 the bias current is set to a fourth level larger than the third level.

* * * * *